US005164244A

United States Patent [19]

Mattesky

[11] Patent Number: 5,164,244

[45] Date of Patent: Nov. 17, 1992

[54] NON-STAINING LUBRICATION OF LAUNDRY IRON SOLES

[75] Inventor: Henry Mattesky, Cedar Grove, N.J.

[73] Assignee: Herbert Glatt, Morristown, N.J.

[21] Appl. No.: 457,306

[22] Filed: Dec. 26, 1989

Related U.S. Application Data

[62] Division of Ser. No. 296,240, Jan. 12, 1989, Pat. No. 4,920,669.

[51] Int. Cl.[5] ..... B05D 3/00; B05D 5/08; B32B 33/00; D06F 83/00

[52] U.S. Cl. ..... 428/196; 38/140; 38/144; 427/197; 428/201; 428/245; 428/246; 428/286; 428/290; 428/341; 428/447; 428/448

[58] Field of Search ..... 428/196, 201, 245, 246, 428/286, 290, 341, 447, 484; 38/144, 140; 427/197

[56] References Cited

U.S. PATENT DOCUMENTS

| | | | |
|---|---|---|---|
| 3,148,467 | 9/1964 | Kerr | 38/140 |
| 3,414,995 | 12/1968 | Adiletta et al. | 38/140 |
| 3,603,011 | 9/1971 | Cohen | 38/140 |
| 4,484,400 | 11/1984 | Lehrman | 428/263 |
| 4,603,494 | 8/1986 | Lehrman | 428/290 |
| 4,621,003 | 11/1986 | O'Kane | 428/71 |
| 4,818,242 | 4/1989 | Burmeister | 8/115.6 |
| 4,920,669 | 5/1990 | Mettesky | 428/266 |

*Primary Examiner*—James C. Cannon
*Attorney, Agent, or Firm*—Omri M. Behr

[57] ABSTRACT

A laundry iron lubricating means is provided comprising a fabric substrate having a coating containing a lubrication agent. In the operation of the device, the hot laundry iron is run over the coated fabric with normal pressure. The lubrication provided by a single pass reduces iron drag by 20 to 50%, adequate for the ironing of at least one large garment without need for a second pass. The greater the sole temperature of the iron, the greater the drag reduction.

7 Claims, 1 Drawing Sheet

NON-STAINING LUBRICATION OF LAUNDRY IRON SOLES

This application is a division of application Ser. No. 07/296,240, filed Jan. 12, 1989, now U.S. Pat. No. 4,920,669.

FIELD OF THE INVENTION

Non-staining lubrication of laundry iron soles.

BACKGROUND OF THE INVENTION

The art of smoothing washed fabrics by means of a gliding pressure placed thereon by a hot metal surface is an extremely ancient one. Modern technology has affected both the means for heating the irons as well as, providing a smooth bottom surface or "sole" which contacts the fabric to be smoothed. Notwithstanding, these improvements a substantial amount of friction inevitably arises during the ironing process, which increases the labor which must be put into this somewhat tiresome but necessary domestic process. It would be desirable to find a mode of applying a lubricating film to the sole of the iron in order to reduce the friction. Such a lubricating film however, must be devoid of any possibility of transferring either odor or discoloration to the garments to be smoothed. Heretofore, no satisfactory lubricant for this purpose has been developed. Attempts have been made to coat the sole of the iron with smooth low friction coatings of inert polymeric materials. Teflon has been used principally for purposes of keeping the soleplate clean with only minor reduction in friction compared to uncoated metal.

SUMMARY OF THE INVENTION

It is the surprising and unexpected finding herein that when the sole of a hot laundry iron is first passed over a silicone elastomer surface, the frictional drag in the subsequent smoothing process using such a iron is substantially reduced. It has further been found that the higher the temperature of the iron, the greater the reduction of drag. While Applicant does not wish to be bound by any theory, it is believed that the heat of the iron causes a very small but never the less significant amount of depolymerization of the elastomer, releasing sufficient silicone, monomer or oligomer to provide a friction reducing coating on the iron sole. The effect may also be due to exceedingly small quantities of relatively low molecular weight silicone oils, normally present in commercial quality silicone elastomers. Thus, the silicone elastomeric coating is believed to act as a reservoir releasing silicone oil, monomers, or oligomers on demand as the hot iron is drawn across the surface.

It has been found that other coatings may be formulated to act in a similar manner. Resin matrices such as acrylic polymers containing a relatively high melting point wax, suitably above 40° preferably above 60° C., such as carnauba wax may be formulated to release the wax to the soleplate, imparting a low friction surface to the soleplate of an iron under heat.

The resin matrices may comprise a variety of polymers and lubricating agents. There may be employed polyvinyl acetate, polyvinyl chloride, poly(styrene/acrylic), poly(styrene/butadiene), polyurethane, epoxy resins and similar polymers. The polymers are formulated with suitable lubricating agents which may include fatty acids, silicone oils and high melting waxes to release the agent to the soleplate, imparting a low friction surface to the soleplate of an iron under heat. Silicone elastomers and acrylic polymers containing carnauba wax, however give superior results.

A laundry iron lubricating means is provided, comprising, suitably, a fabric substrate having a coating containing a lubricating agent, preferably a silicone elastomer, deposited thereon. Suitably, the fabric is a woven or non woven fabric which may be woven from monofilament threads or from natural or synthetic polyfilamentous fibre threads. The device operates which greatest efficiency when the maximum surface area of the elastomer can actually contact the sole of the laundry iron, thus adsorption on the surface of the threads rather than in the interstices of the filaments is desirable.

Superior results are obtained where the absorbency of polyfilamentous threads has been reduced by at least 50% prior to application thereto of said silicone elastomer. This is most readily achieved by conventional techniques of coating or printing onto the fabric with appropriate coating compounds or inks.

While the invention is not limited thereto, a highly desirable embodiment of the device is one wherein the fabric is part of the upper surface of an ironing board cover and the lubricating coating is at least a strip provided thereon. The lubricating coating may cover the entire upper surface of the cover. Thus such a device would comprise a cotton fabric, previously printed with an ink containing a binder component, such as an acrylic resin binder conventionally used in such inks and coated with at least 3 $g/m^2$, dry loading, of at least one lubricating agent, suitably of silicone elastomer or a resin matrix such as acrylic/carnauba wax compound.

In the operation of the device, the hot laundry iron, having a sole plate temperature of between about 100° C. and 290° C., is run over the coated fabric with normal pressure. The lubrication provided by a single pass reduces iron drag by 20 to 50% and is adequate for the ironing of at least one large garment without need for a second pass. The greater the sole temperature of the iron, the greater the drag reduction.

BRIEF DESCRIPTION OF THE DRAWINGS

The FIGURE shows a plan view of an ironing board cover having a lubricating area in accordance with the present invention.

DETAILED DESCRIPTION OF THE DRAWINGS

Figure 1:
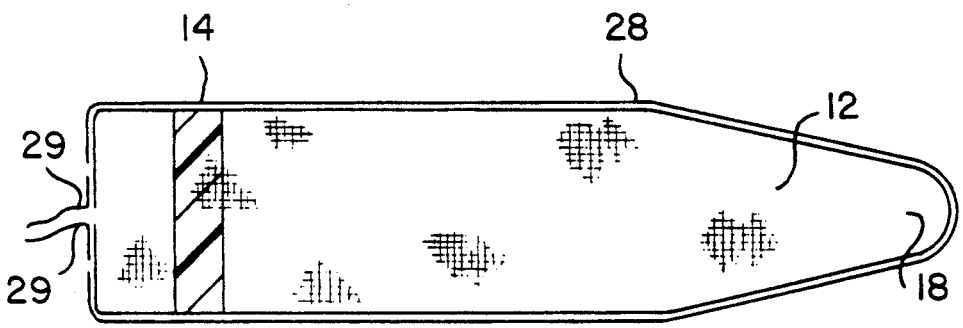

FIG. 1 comprises a conventional ironing board cover 12 having a draw string channel 28 containing draw string 29 for affixing said cover on top of an ironing board. Strip 14 is a portion of fabric 12 of the ironing board cover having been coated with the elastomeric coating of the present invention.

DESCRIPTION OF THE PREFERRED EMBODIMENTS

The basic finding of the present invention is that it is possible to place a very thin, but antifrictionally effective coating upon the sole of a hot iron by sliding the sole of such a hot iron over a surface having a non-greasy lubricant applied thereon. The lubricants are incorporated in a coating containing binders which are included but not limited to vinyl, vinyl acetate, acrylic, urethane, silicone, and silicone rubber. Among the lubricants which give rise to such an effect are dihydrogenated tallowdialkyl ammonium alkyl salts, such as dihydrogen tallowdimethylammonium methyl sulfate, coconut fatty acid soaps, waxes, suitably of melting point above 60° C., such as paraffin waxes, carnauba waxes and silicone, silicone elastomers and acrylic-carnauba wax mixtures have been found the most practical. The dihydrogenated tallow alkylammonium alkyl salts, while giving excellent ironing lubrication, had very poor scorch resistance. Similarly, the coconut fatty acid soap, while it had excellent lubrication and poor scorch resistance, also generated an objectional odor under heat. The paraffin wax while again a good lubricant, generated smoke and wax odor. Moreover, the duration of lubrication is exceedingly short (less than five minutes) and the wax rapidly vaporized under the application of heat.

Silicone rubbers while known for their ability to provide a smooth surface, are not generally noted for their lubricating qualities (in contrast to certain silicone oils which are known to have this property and are widely commercially used to this purpose).

The basis to the present invention was noted during certain experiments relating to the puncture resistance of calendared urethane foam coated with silicone rubbers. As a result of these experiments tests were carried out to determine the parameters of this property. It was noted that optimum results were obtained when the coating was on the surface of the substrate. It is, of course, possible to place a substantially unbroken silicone surface upon any substrate over which a hot iron may pass. Such an approach however, is needlessly consumptive of expensive silicone elastomer materials.

When these silicone elastomer materials were coated upon untreated fabric materials, the aqueous emulsion containing the silicone elastomers was absorbed into the interstices of the fibers in the threads to such an extent that an insufficiently large amount of silicone elastomer was available for contact with the iron sole.

It was found that this disadvantage could be avoided by pretreating the fabric with conventional processes such as those normally utilized to print a color or a decorative pattern upon the fabric, pre-coating the fabric or by utilization of fabrics made of non-absorbent threads such as monofilaments. Pigment printing or coating normally contains an acrylic binder to adhere pigment fillers, etc. to the fabric. This also acts as a surface sealant wherein the absorbency in the fabric is reduced by at least 50%. The availability of the coating containing lubricating agents to the iron soleplate was substantially amplified. It was further found that incorporating a foaming agent in the coating compound and applying the coating as a foam, penetration was reduced sufficiently to achieve the desired result.

While coating loadings as low as 3 g/m$^2$ (dry weight) of lubricant, suitably silicone elastomer, give rise to noticeable improvements in reduction of drag, it is desirable to utilize loadings of the order of from about 12 to about 60 g/m$^2$, depending on the lubricant resin combination used and the ratio of lubrication to binder.

It also has been found that only a very small amount of lubricating agent is necessary to be transferred to the soleplate of the iron to significantly enhance the drag reduction. It was found that less than 0.01 grams achieves the desired results.

For ease of manufacture, it is preferred to utilize water based silicone elastomers and other acrylic emulsion resins. These materials also have good heat resistance, an important characteristic, since these materials will be subjected to temperature of up to 250° C. While the actual composition of such elastomers and emulsions are considered as trade secrets by their manufactures, they are broadly available commercially and relevant physical characteristics therefore are published. Examples of suitable elastomers which may be employed for the present purpose is Union Carbide LE-9300 Silicone Emulsion, manufactured by Union Carbide Corporation, Danbury, Conn. SLE-5300 and SLE 5500 manufactured by General Electric Company Silicone Products Division, Waterford, N.Y. may also be employed, however, these materials are supplied as two component silicone liquid elastomers and must be applied together with the curing agent in accordance with the manufactures instructions. Most preferred however, are silicone water based elastomers such as Dow Corning 3-5024 or 3-5025, manufactured by the Dow Corning Corporation of Midland, Mich. These elastomers do not require the presence of a curing agent and cure in approximately two hours at ambient temperature, although the cure time can be accelerated by raising the temperature or lowering the humidity. Suitably is utilized an aqueous suspension of the silicone elastomer diluted with between 5 and 30%, suitably about 20% water containing a thickening agent suitably a premixed cellulosic thickening agent such as Methocel F4M (manufactured by Dow Chemical Company) to the extent of from about 0.25 to 2 suitably about 1% by weight, to provide a composition suitable for printing onto the fabric substrate. In the preferred procedure the composition is printed onto the fabric substrate. The composition can be deposited on the substrate by printing through a mesh screen, or can be knife, roller, or spray coated.

Examples of suitable acrylic emulsion resins which may be employed for the present purpose are Rhoplex HA-18, Rhoplex HA-12, Rhoplex HA-16 manufactured by Rohm and Haas Company Philadelphia, PA.; UCAR Latex 862, UCAR Latex 865, UCAR Latex 874, manufactured by Union Carbide Corporation, New York, N.Y. and WRL 0402, manufactured by Walsh Chemical Corp., Gastonia, N.C.

These resins are normally dried and cured for approximately one minute at 325° F. Carnauba Wax in emulsion form such as Duramul 0814, manufactured by Astor Wax in Harrison, N.Y. is employed as a lubricating agent. The ratio of wax to resin can be ranged from 0.5:1 to 4.0:1 with the preferred level approximately 3.0:1, wax:resin.

Alternatively, the emulsion may be formulated in a water based foam which is then coated or printed onto the surface of the fabric. The advantage of the foam deposition method is that it reduces the incidence of fiber penetration and enhances the deposition of the lubricating coating upon the surface of the fabric substrate.

EXAMPLE I

| Formulation: | |
|---|---|
| Water | 20 g |
| Dow Corning Silicone 3-5024 | 100 g |
| Methocel F4M | 1 g |

The material was mixed at room temperature to provide a paste suitable for printing and was applied by printing through a 40 mesh screen upon a printed cotton fabric. Said cotton fabric had previously been printed with a printing compound containing an acrylic resin binder.

EXAMPLE II

| Formulation: | |
|---|---|
| Water | 60.0 g |
| Methocel F4M | 1.5 g |
| Rhoplex HA-12 | 10.0 g |
| Duramul 0814 | 30.0 g |
| Wax-resin (solids) ratio | 2.33/1.0 |

The material was mixed at room temperature to provide a paste suitable for printing and was applied by printing through a 40 mesh screen upon a printed cotton fabric. Said cotton fabric had previously been printed with a printing compound containing an acrylic resin binder. Coating Wt. g/m$^2$: 11.3, Iron Drag Reduction: 55.5%.

In accordance with the above procedure, but in place of Rhoplex, there are employed similar formulations of polyvinyl acetate, polyvinyl chloride, poly(styrene/acrylic), poly(styrene/butadiene), polyurethane, epoxy resins.

Similarly, in place of Duramul, the polymers are formulated with fatty acids, silicone oils and high melting waxes.

EXAMPLE III

| Foam Formulation: | |
|---|---|
| Water | 60.0 (premix at 120° F.) |
| Methocel F4M | 0.75 (premix at 120° F.) |
| Rhoplex HA-12 (45% solids) | 10.0 |
| Duramul 0814 (35% solids) | 30.0 |
| | 100.75 |
| Wax-resin (solids) ratio | 2.33/1.0 |

The formulation was foamed in a Hobart Kitchen Aid mixer, Model K5SS to a density of 200 g/liter. The foam coating applied to printed bleached cotton sheeting with a spatula. The coating was dried in a 325° F. convection oven for five minutes to yield a coating weight: 5.0 g/m$^2$.

The effectiveness of iron lubrication was measured by following Magla test method described in Example IV below. Drag reduction: 70%.

EXAMPLE IV

Measurement of iron lubrication

The apparatus comprises a Dayton gear motor attached to a Wagner 102 force dial which in turn, is attachable to the iron under test. A piece of clean fabric is provided on top of a horizontal ironing board. The potential distance of travel of the iron is 86 cm. The iron is heated to a predetermined temperature suitably, about 245° C. and rubbed vigorously three times over the sample silicone coating. The iron is then placed at one end of the test path, a weight of approximately 3.5 kg is placed on the iron and the forced dial attached to the iron. The gear motor is then activated to run at constant speed and the reading on the force dial measured when the front of the iron passes the halfway point on the path i.e. 43 cm.

I claim:

1. A laundry iron lubricating means comprising a fabric substrate comprising a multiplicity of threads, comprising a first coating of sufficient ink and polymeric resins printed or coated on said substrate to reduce the absorbency of said substrate by at least 50%, said first coating being coated with a second coating selected from the group consisting of silicone elastomers and resin matrices containing lubricating agents.

2. A means of claim 1 wherein the substrate is a woven or non-woven fabric.

3. A means of claim 1 wherein the second coating is a silicone elastomer.

4. A laundry iron lubricating means comprising a fabric substrate comprising a multiplicity of threads, comprising a first coating having sufficient ink or polymeric resins printed or coated on said substrate to reduce the absorbency of said substrate by at least 50%, said first coating being coated with a second coating selected from the group consisting of silicone elastomers and resin matrices containing lubricating agents, wherein the first coating is an acrylic polymer matrix containing carnauba wax.

5. A laundry iron lubricating means comprising a fabric substrate comprising a multiplicity of threads, comprising a first coating having sufficient ink or polymeric resins printed or coated on said substrate to reduce the absorbency of said substrate by at least 50%, said first coating being coated with a coating selected from the group consisting of silicone elastomers and resin matrices containing lubricating agents wherein the lubricating agent of said second coating is a wax with a melting point greater than 40° C.

6. A means of claim 5 wherein the lubricating agent is a wax with a melting point greater than 60° C.

7. A means of claim 5 wherein the lubricating agent is a Carnauba wax.

* * * * *